US005331880A

United States Patent [19]

Bartolles

[11] Patent Number: 5,331,880

[45] Date of Patent: Jul. 26, 1994

[54] WEDGE-TYPE BREECHBLOCK FOR A GUN

[75] Inventor: Rolf Bartolles, Korschenbroich, Fed. Rep. of Germany

[73] Assignee: Rheinmetall GmbH, Dusseldorf, Fed. Rep. of Germany

[21] Appl. No.: 933,801

[22] Filed: Aug. 24, 1992

[30] Foreign Application Priority Data

Aug. 23, 1991 [DE] Fed. Rep. of Germany ..... 4128055

[51] Int. Cl.[5] ..... F41A 3/12

[52] U.S. Cl. ..... 89/24; 89/27.13

[58] Field of Search ..... 89/24, 27.13, 17, 22, 89/23, 25, 26; 42/1.02, 17, 21

[56] References Cited

U.S. PATENT DOCUMENTS

| | | | |
|---|---|---|---|
| 474,289 | 5/1892 | Camet | 89/27.13 |
| 487,586 | 12/1892 | Steinert | 89/24 |
| 1,091,638 | 3/1914 | Dawson et al. | 89/27.13 |
| 1,095,558 | 5/1914 | Dawson et al. | 89/27.13 |
| 3,099,937 | 8/1963 | Bartels | 89/24 |
| 4,558,626 | 12/1985 | Bartolles | 89/24 |
| 4,991,490 | 2/1991 | Balbo et al. | 89/24 |
| 5,054,365 | 10/1991 | Wissing | 89/24 |
| 5,115,716 | 5/1992 | Doering et al. | 89/27.13 |

FOREIGN PATENT DOCUMENTS

| | | | |
|---|---|---|---|
| 2008255 | 1/1973 | Fed. Rep. of Germany | 89/27.13 |

*Primary Examiner*—Stephen M. Johnson
*Attorney, Agent, or Firm*—Spencer, Frank & Schneider

[57] ABSTRACT

A wedge-type breechblock is disposed at the breech end of a gun. A cartridge chamber having a length L1 in the wedge-type breechblock accommodates propellant igniters, with obturation being effected by the respective propellant igniters. A firing mechanism operatively disposed at the wedge-type breechblock detonates propellant igniters loaded into the cartridge chamber from a magazine. A propellant igniter magazine is disposed adjacent the wedge-type breechblock and includes a guide chute and individual propellant igniters lined up in a row in the guide chute. The propellant igniters each have a casing and a length L2 which is greater than the length L1 of the cartridge chamber so that when a propellant igniter is loaded in the cartridge chamber in a firing position, a rear portion of the propellant igniter remains within the casing.

11 Claims, 4 Drawing Sheets

FIG.5
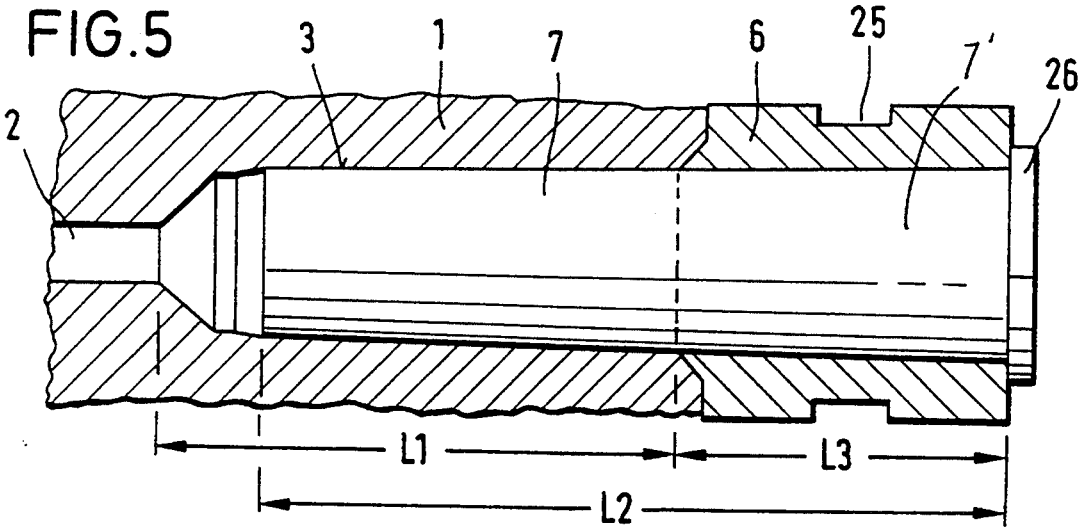
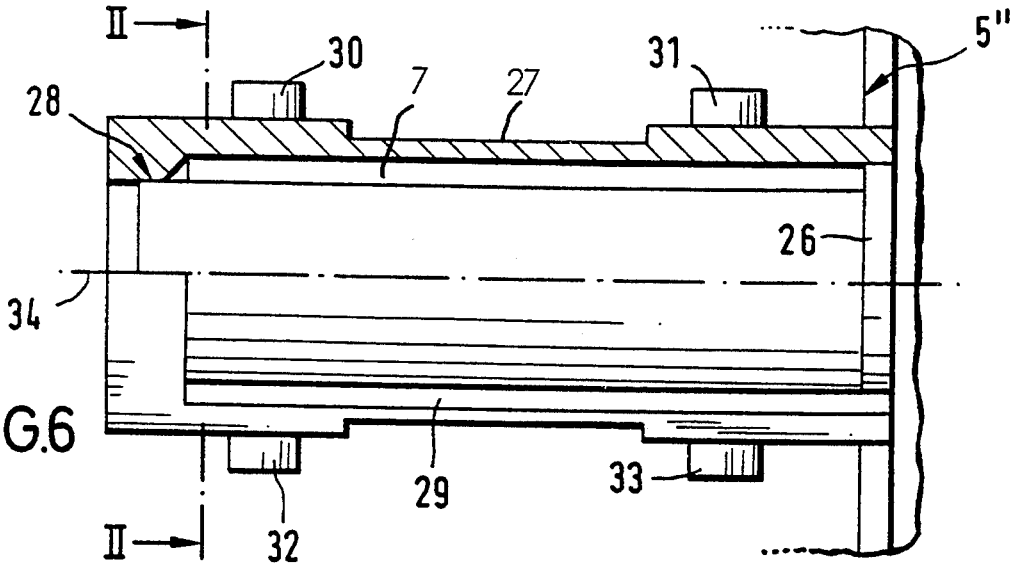
FIG.6
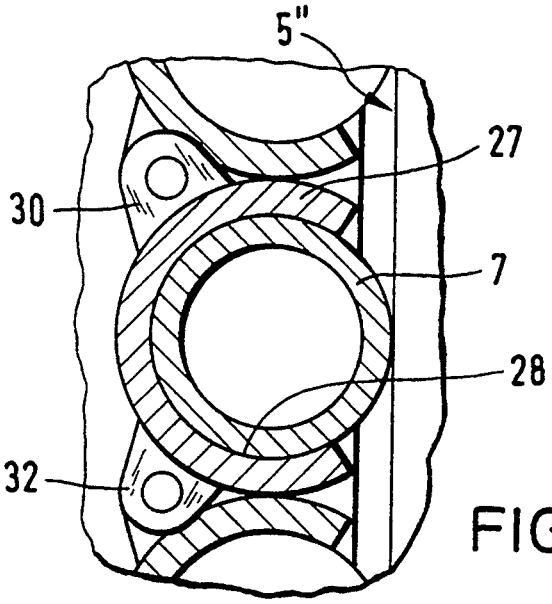
FIG.7

WEDGE-TYPE BREECHBLOCK FOR A GUN

BACKGROUND OF THE INVENTION

The present invention relates to a wedge-type breechblock arrangement for a gun, with a propellant igniter magazine disposed adjacent the wedge-type breechblock and including a guide chute and individual propellant igniters lined up in a row in the guide chute.

Wedge-type gun breechblock arrangements of this type are disclosed, for example, in German Patent No. DE 3,233,749.A1 and corresponding U.S. Pat. No. 4,558,626. The igniter magazine disclosed in this patent includes a linear magazine chute to accommodate the propellant igniters so that it is necessary to exchange magazines after a small number of rounds are fired. Other significant drawbacks are that, for example, in order to be ignited, each propellant igniter must be pushed completely out of the magazine into the cartridge chamber of the breechblock wedge and, in addition, the magazine must then be moved transversely in order to perform the ignition process. It is further necessary to provide a relatively complicated extractor and ejector device for the extraction and ejection of the casing of an ignited propellant igniter from the cartridge chamber. Further, in this prior art breechblock, obturation is provided by the propellant igniter itself.

German Patent No. 3,921,767.A1, corresponding to U.S. Pat. No. 5,054,365, discloses a propellant igniter magazine for a wedge-type breechblock that has an enlarged cartridge holding capacity by providing the magazine with an endless chute in which the propellant igniters can be stored in significantly larger numbers. The propellant igniters are stored within the guide chute in a row of casings. The interior of each casing is configured as the charge chamber for a received propellant igniter and is disposed in a firing position within the propellant igniter magazine. In this arrangement, the breechblock includes only the firing channel. A separate cartridge chamber is not necessary.

A drawback of this wedge-type breechblock is that an additional sealing means is required for obturation between the breechblock and the respective casing. This sealing means must be monitored constantly and exchanged relatively frequently.

SUMMARY OF THE INVENTION

It is an object of the present invention to further develop a wedge-type breechblock of the above-mentioned type in which obturation is effected by the propellant igniter itself so that the breechblock is simple and easily manipulated and wherein, after firing, the propellant igniters return to the igniter magazine instead of being removed from the breech area by way of a complicated ejection mechanism.

The above and other objects are accomplished in accordance with the invention by the provision of arrangement in the context of a gun having a breech end, comprising: a wedge-type breechblock disposed at the breech end of the gun; a cartridge chamber having a length L1 in the wedge-type breechblock for accommodating propellant igniters, with obturation being effected by the respective propellant igniters; a firing mechanism operatively disposed at the wedge-type breechblock for detonating propellant igniters in the cartridge chamber; loading means for loading a propellant igniter with the cartridge chamber from a magazine; a propellant igniter magazine disposed adjacent the wedge-type breechblock and including a guide chute and individual propellant igniters lined up in a row in the guide chute, the propellant igniters each having a casing and a length L2 which is longer than the length L1 of the cartridge chamber so that when a propellant igniter is loaded in the cartridge chamber in a firing position, a rear portion of the propellant igniter remains within the casing.

The present invention is thus based essentially on the concept of combining the advantages of German Patent No. 3,233,749.3 A1, corresponding to U.S. Pat. No. 4,558,626, and German Patent No. 3,921,767.A1, corresponding to U.S. Pat. No. 5,054,365, without having to accept their drawbacks. This is accomplished in that the propellant igniter, when it is in the firing position, is neither introduced completely into the cartridge chamber of the breechblock, nor does it remain completely in the propellant igniter magazine. Rather the length L1 of the cartridge chamber and the length L2 of the propellant igniter are selected so that $L1<L2$. This results in simple ana robust obturation, with the fired casing of the propellant igniter being retracted easily into the magazine.

Advantageously, a propellant igniter magazine is employed which has an endless chute so that a large number of propellant igniters can be held in readiness.

Further details and advantages of the invention will become evident from the embodiments of the invention that will now be described in greater detail with reference to the drawing figures.

BRIEF DESCRIPTION OF THE DRAWINGS

FIG. 5 is a partial axial cross-sectional view showing a propellant igniter disposed in the breechblock with a casing at its rear end.

FIG. 6 is a partial axial cross-sectional view of a further embodiment of a casing in which the entire propellant igniter is accommodated.

FIG. 7 is a sectional view along the line marked II—II in FIG. 6.

DESCRIPTION OF PREFERRED EMBODIMENTS

Figure 1:
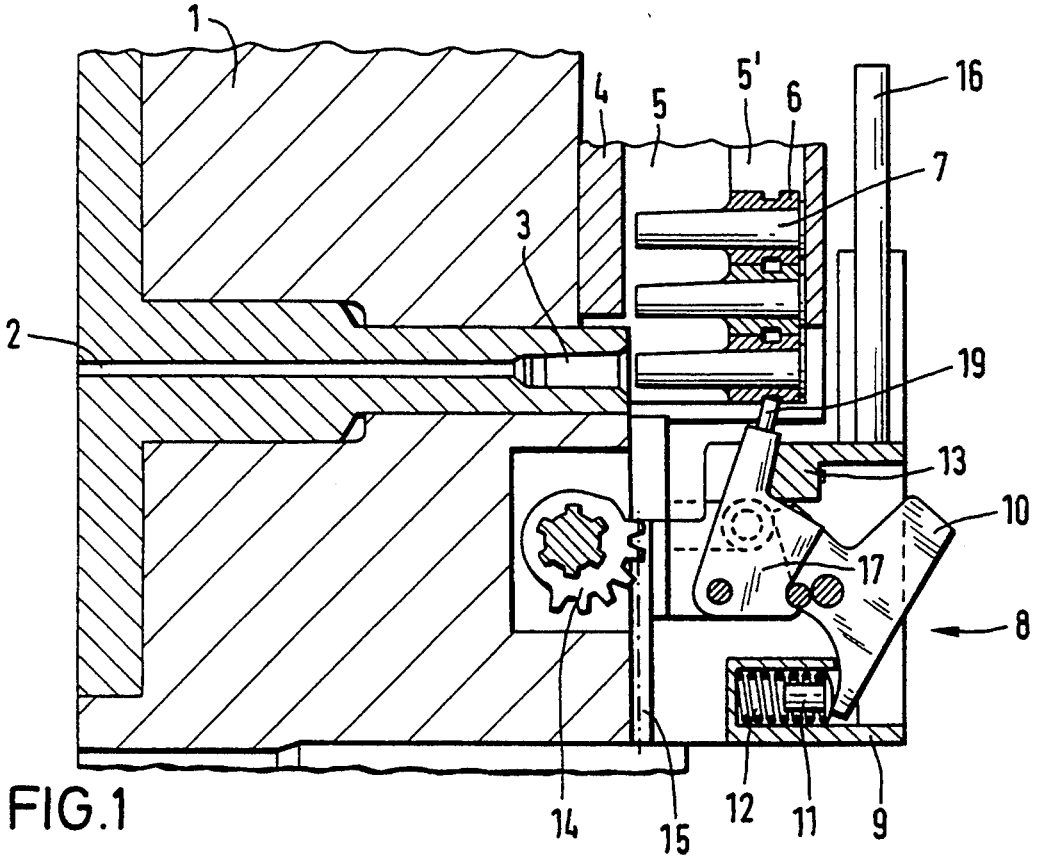
FIG. 1 is a partial cross-sectional view of a first embodiment of a wedge-type breechblock arrangement including a propellant igniter magazine and a firing mechanism, with the breechblock being shown in the charging position.
Figure 2:
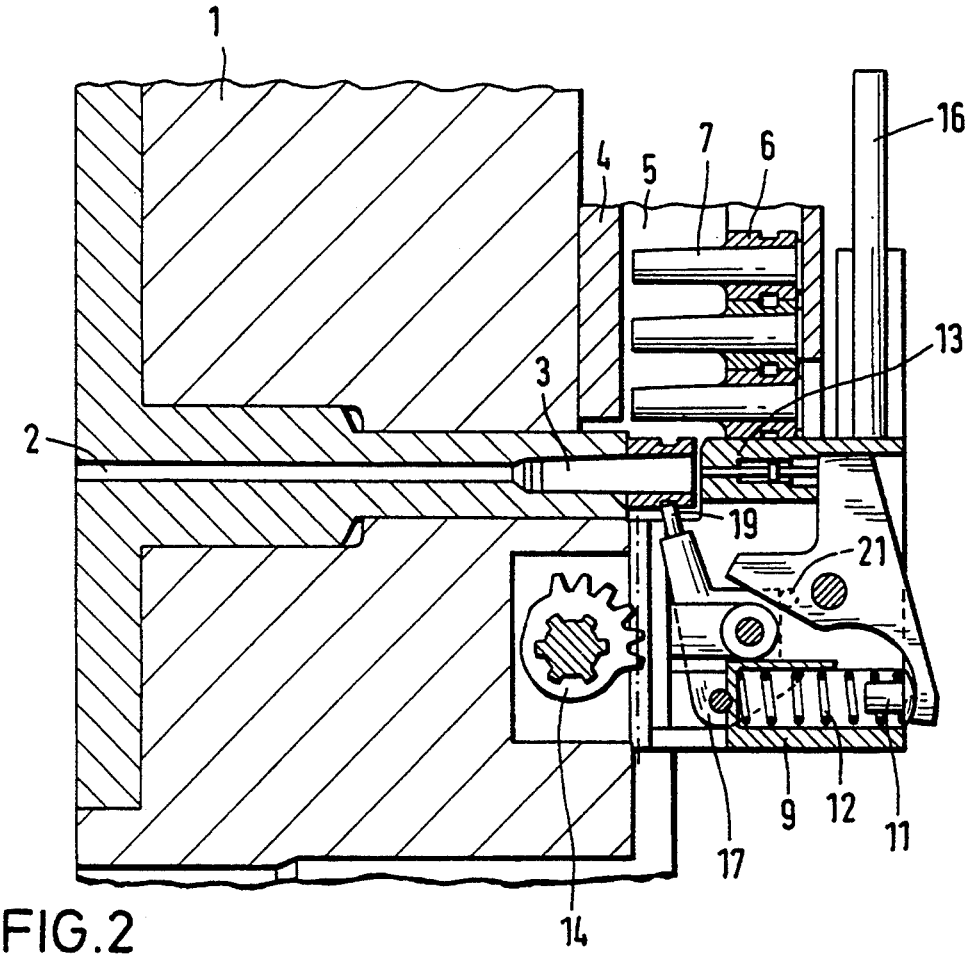
FIG. 2 is a partial cross-sectional view similar to FIG. 1 which shows the wedge-type breechblock in a firing position.

Referring to FIGS. 1 and 2, there is shown a portion of a wedge-type breechblock 1 including a firing channel 2 and a cartridge chamber 3 for propellant igniters 7. Breechblock 1 is followed by a propellant igniter magazine 4 which corresponds essentially to that of German Patent No. 3,921,767. A1, corresponding to U.S. Pat. No. 5,054,365 and includes a guide chute 5, which is preferably an endless chute, in which individual propellant igniters 7 are disposed in casings 6. Casings 6 and igniters 7 are guided in a guide groove 5'.

A firing mechanism 8, which is generally similar to that disclosed U.S. Pat. No. 5,054,365 mentioned above, is composed of a housing 9, a percussion member 10 rotatably disposed at the housing, a hammer 11, against which presses a coil spring 12, and a housing portion 13 accommodating a firing pin. Firing mechanism 8 can be raised and lowered by means of a toothed wheel 14 disposed at breechblock 1 and by way of a toothed rod 15 that is fixed to housing 9. Firing is initiated by way of a firing lever 16.

Figure 3:
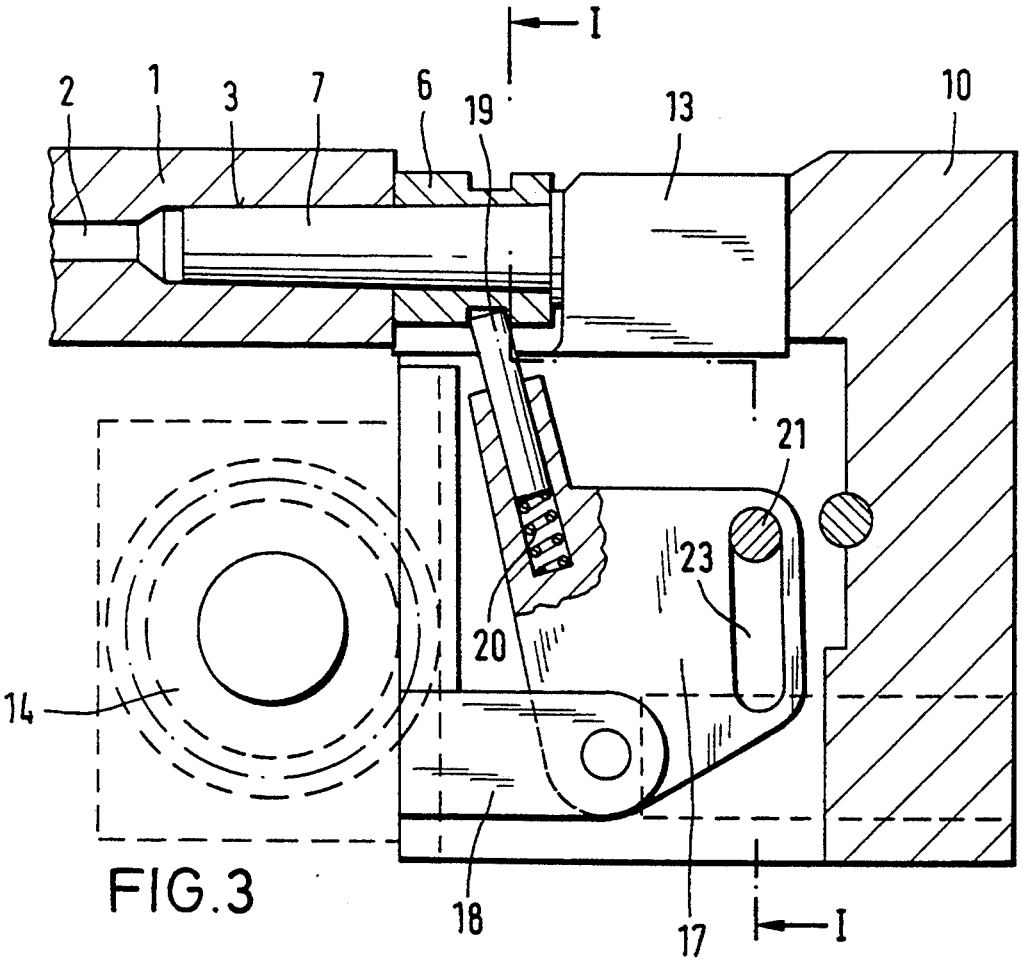
FIG. 3 is an enlarged sectional view of a portion of FIG. 2.

In contrast to prior art arrangements, an engaging lever 17 is provided which is arranged to be pivotal about a bearing 18 fastened to breechblock 1 as best shown in FIG. 3. A front portion 19 of engaging lever 17, which is charged by a coil spring 20, pushes the propellant igniters into cartridge chamber 3 and, after firing, extracts them therefrom. For this purpose, two pins 21 and 22 fastened to housing 9 (see FIG. 4) engage in control grooves 23 and 24 provided in engaging lever 17 and translate the raising and lowering movement of firing mechanism 8 into a corresponding shifting movement of propellant igniter 7.

As indicated in FIGS. 1 to 3 and shown in detail in FIG. 5, a rear end portion 7' of propellant igniter 7 is form-lockingly encased by casing 6 whose length L3 is less than the length L2 of propellant igniter 7. Additionally, casing 6 is provided with an annular groove 25 into which engages a front portion 19 of engaging lever 17 in order to push propellant igniter 7 into cartridge chamber 3 and, after firing, to transport the empty casing of the propellant igniter back into the magazine.

While FIG. 1 shows the state in which the propellant igniter is being introduced into cartridge chamber 3, FIG. 2 shows the state of the device during firing. The firing lever 16 here releases percussion member 10 that has been pre-tensioned by spring 12 which thus hits the firing pin in housing portion 13. This pin then strikes the percussion cap of the propellant igniter, thereby initiating a round.

Figure 4:
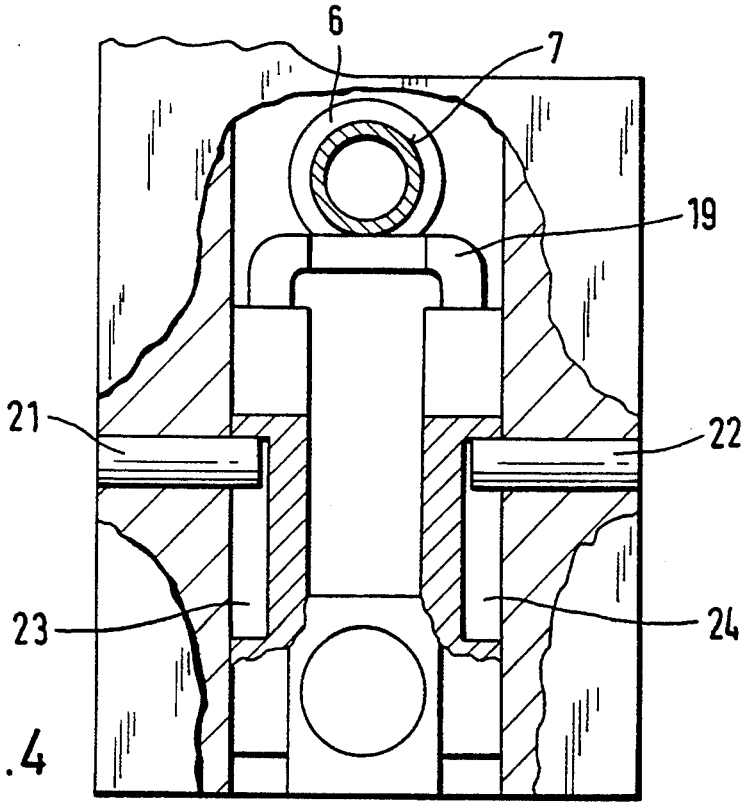
FIG. 4 is a sectional view along the line marked I—I in FIG. 3.

FIG. 3 shows in somewhat greater detail the front portion 19 of engaging lever 17 as it engages into annular groove 25 of casing 6. As can further be seen, the housing portion 13 of the firing mechanism lies against the rear end surface of the propellant igniter 7 in a force lock. FIG. 4 shows that front portion 19 of engaging lever 17 may be a bracket-shaped component.

Figure 8:
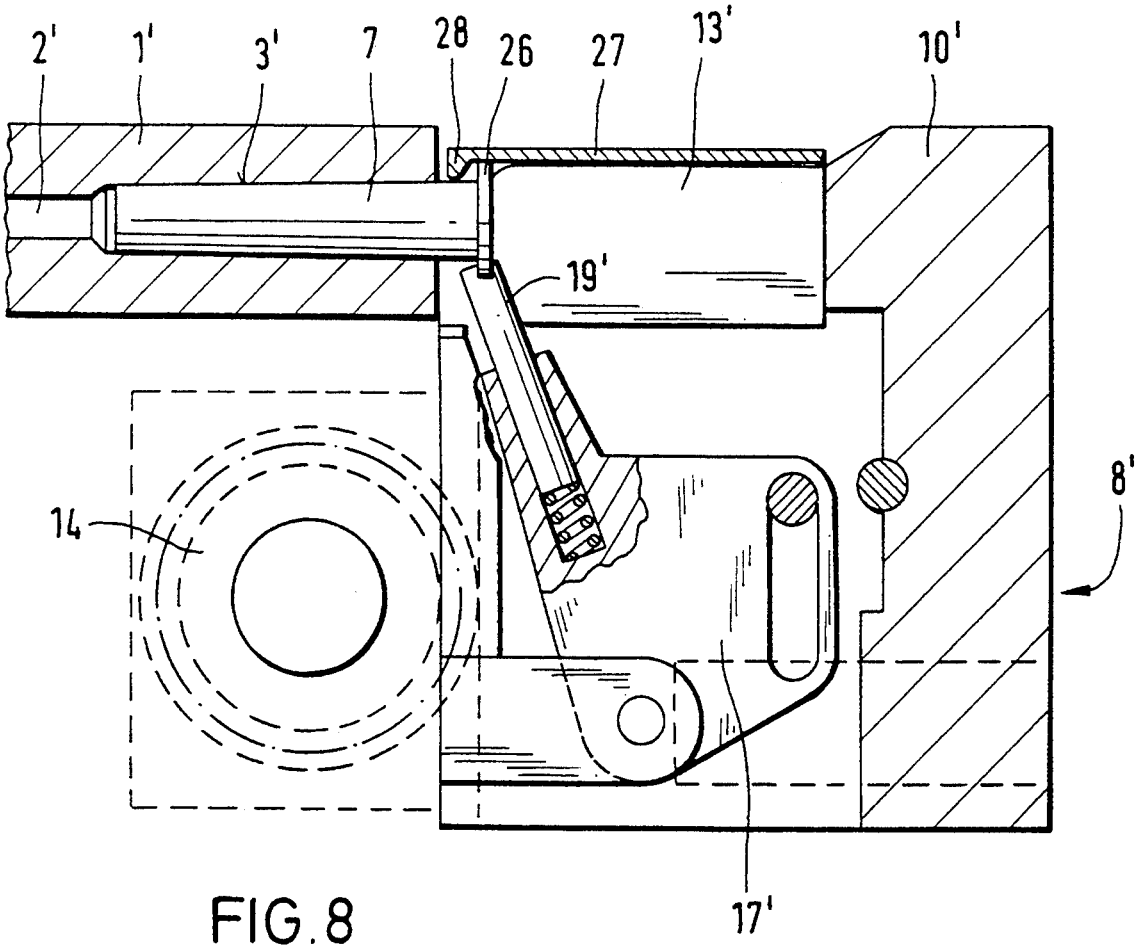
FIG. 8 is a sectional view showing the breechblock of FIG. 6 including propellant igniter and casing in the firing position.

A second embodiment is disclosed in FIGS. 6 to 8. In this embodiment, a casing 27 which completely encloses the respective igniter 7 is selected to accommodate propellant igniter 7. The individual casings 27 are connected with one another by means of chain studs 30 to 33 (see FIGS. 6 and 7) to form a chain of casings which is accommodated in the propellant igniter magazine and is driven by a chain wheel that is not shown.

FIG. 6 shows such a casing 27 holding a propellant igniter 7, with the upper half of casing 27 being shown in section. In a front portion of casing 27 which faces the breechblock, propellant igniter 7 is centered with the aid of appropriate means 28, for example, in a bore and is held axially by way of an edge of the casing in a continuous guide groove 5'' in the propellant igniter magazine.

In the loading position, guide groove 5'' is interrupted to such an extent that propellant igniter 7 can be displaced axially (FIG. 7). An engaging bar 19' (FIG. 8) for pushing propellant igniter 7 extends through a slot-shaped opening 29 in casing 27, which slot extends parallel to the longitudinal axis 34 of the casing (FIG. 6), and thus grips around the edge of the bottom (rear end) 26 of the propellant igniter. A housing portion 13' which includes the firing pin is also able to move through slot-shaped opening 29 to a position behind the propellant igniter to engage the end surface of the bottom surface 26 in force lock and thus support the propellant igniter during firing (FIG. 8).

In the second embodiment, it is thus no longer the casing surrounding the propellant igniter that is displaced, but only the propellant igniter 7 itself. However, the rear end 26 of the propellant igniter is still within casing 27 in the firing position so that fast loading of the propellant igniter into cartridge chamber 3' and from cartridge chamber 3' into the magazine is ensured.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In a gun having a breech end, an arrangement comprising:

a wedge-type breechblock disposed at the breech end of the gun;

a cartridge chamber having a length L1 in said wedge-type breechblock for accommodating a propellant igniter;

a propellant igniter magazine disposed adjacent said wedge-type breechblock and including a guide chute and individual propellant igniters lined up in a row in said guide chute, said individual propellant igniters each being at least partially encased by an exterior casing and having a length L2 which is longer than the length L1 of said cartridge chamber so that when one of said propellant igniters is loaded in said cartridge chamber in a firing position, a rear portion of said propellant igniter remains within said casing;

loading means for loading one of said propellant igniters into said cartridge chamber from said magazine, said loading means including an engaging lever having a front, spring tensioned portion pivotably fastened to said breechblock for engaging one of a respective one of said casings and its associated said propellant igniter and for pushing the associated said propellant igniter into and out of said cartridge chamber; and a firing mechanism operatively disposed at said wedge-type breechblock for detonating a respective one of said propellant igniters in said cartridge chamber, with said firing mechanism being mounted for displacement relative to said breechblock, said engaging lever including grooves, and said firing mechanism including two pins which engage in said grooves so that, when said firing mechanism is displaced relative to said breechblock, said engaging lever is caused to rotate and to displace said associated said propellant igniter.

2. The arrangement of claim 1, wherein the casing of each said propellant igniter has a length L3 which is less than the length L2 of the propellant igniter, and the casing enclosed the rear end of the propellant igniter in a form locking manner so that, in order to fire the propellant igniter, the propellant igniter along with its casing, is pushed for loading the propellant igniter into the cartridge chamber.

3. The arrangement of claim 2, wherein each said casing has an annular groove into which engages the front portion of said engaging lever in order to load or extract the respective propellant igniter into and out of said cartridge chamber, respectively.

4. The arrangement of claim 1, wherein said casings each have a length which is approximately the same length as that of said propellant igniters, have a slot-shaped opening extending parallel to a longitudinal axis of said casing, and include on their side facing the wedge-type breechblock means for centering the propellant igniter disposed in the respective said casing.

5. The arrangement of claim 4, and further including chain studs connecting said casings with one another.

6. The arrangement of claim 4, wherein said front portion of said engaging lever is shaped to grip through the slot-shaped openings and around a bottom portion of the propellant igniter in order to load and remove the respective propellant igniter into and out of said cartridge chamber, respectively.

7. The arrangement of claim 1, wherein said firing mechanism includes a housing portion having a firing pin, said housing portion, in a firing position, lying in a force lock against a rear end of a respective one of said propellant igniters disposed in said cartridge chamber.

8. In a gun having a breech end, an arrangement comprising:

a wedge-type breechblock disposed at the breech end of the gun;

a cartridge chamber having a length L1 in a said wedge-type breechblock for accommodating propellant igniters;

a propellant igniter magazine disposed adjacent said wedge-type breechblock and including a guide chute and individual ones of said propellant igniters lined up in a row in said guide chute, said individual propellant igniters each being partially encased by an exterior casing and having a length L2 which is longer than the length L1 of said cartridge chamber so that when one of said propellant igniter is loaded in said cartridge chamber in a firing position, a rear portion of said propellant igniter remains within said casing, and each said casing has an annular groove;

loading means for loading one of said propellant igniters into said cartridge chamber from said magazine, said loading means including an engaging lever having a front, spring tensioned portion which is pivotably fastened to said breechblock and which engages in said groove of a respective said casing in order to load or extract the respective said propellant igniter into and out of said cartridge chamber; and a firing mechanism operatively disposed at said wedge-type breechblock for detonating a respective one of said propellant igniters in said cartridge chamber.

9. The arrangement of claim 8, wherein said casing of each said propellant igniter has a length L3 which is less than the length L2 of the propellant igniter, and said casing encloses only the rear end of the propellant igniter in a form locking manner so that, in order to fire said propellant igniter, said propellant igniter along with its casing, is pushed for loading said propellant igniter into said cartridge chamber.

10. In a gun having a breech end, an arrangement comprising:

a wedge-type breechblock disposed at the breech end of the gun;

a cartridge chamber having a length L1 in said wedge-type breechblock for accommodating propellant igniters;

a propellant igniter magazine disposed adjacent said wedge-type breechblock and including a guide chute and individual ones of said propellant igniters lined up in a row in said guide chute, said individual propellant igniters each being at least partially encased by an exterior casing and having a length L2 which is longer than the length L1 of said cartridge chamber so that when a propellant igniter is loaded in said cartridge chamber in a firing position, a rear portion of said propellant igniter remains within said casing, and wherein chain studs are provided and connect said casings with one another, and said casings each having a length which is approximately the same length as that of said propellant igniters, having a slot-shaped opening parallel to a longitudinal axis of said casing, and includes, on their side facing the wedge-type breechblock, means for centering the propellant igniter disposed in the respective said casing;

loading means for loading one of said propellant igniters into said cartridge chamber from said magazine; and a firing mechanism operatively disposed at said wedge-type breechblock for detonating one of said propellant igniters in said cartridge chamber.

11. The arrangement of claim 10, wherein said loading means includes an engaging lever having a front, spring tensioned portion pivotably fastened to said breechblock for engaging and pushing the propellant igniters into and out of said cartridge chamber, wherein the front portion of said engaging lever is shaped to extend through the slot-shaped openings and grip around a bottom portion of the propellant igniter in order to load and remove the respective propellant igniter into and out of said cartridge chamber, respectively.

* * * * *